US009900688B2

(12) United States Patent
Wang et al.

(10) Patent No.: US 9,900,688 B2
(45) Date of Patent: Feb. 20, 2018

(54) BEAMFORMING AUDIO WITH WEARABLE DEVICE MICROPHONES

(71) Applicant: Intel Corporation, Santa Clara, CA (US)

(72) Inventors: Jian Wang, Shanghai (CN); Hong W. Wong, Portland, OR (US); Xiaoguo Liang, Shanghai (CN); Alexander Uan-Zo-Li, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/125,413

(22) PCT Filed: Jun. 26, 2014

(86) PCT No.: PCT/CN2014/080821

§ 371 (c)(1),
(2) Date: Sep. 12, 2016

(87) PCT Pub. No.: WO2015/196411

PCT Pub. Date: Dec. 30, 2015

(65) Prior Publication Data

US 2017/0150255 A1 May 25, 2017

(51) Int. Cl.
*H04R 3/00* (2006.01)
*H04R 29/00* (2006.01)

(52) U.S. Cl.
CPC ..... *H04R 3/005* (2013.01); *H04R 29/005* (2013.01); *H04R 2430/23* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 5,793,875 | A * | 8/1998 | Lehr | H04R 25/554 381/313 |
| 8,411,891 | B2 | 4/2013 | Del Prete | |
| 9,432,768 | B1 * | 8/2016 | O'Neill | H04R 3/005 |
| 2009/0164219 | A1 | 6/2009 | Yeung et al. | |
| 2011/0205851 | A1 | 8/2011 | Harris | |
| 2012/0201412 | A1 | 8/2012 | Del Prete | |
| 2013/0101136 | A1 * | 4/2013 | McElveen | H04R 3/005 381/92 |
| 2013/0135097 | A1 | 5/2013 | Doezema | |
| 2013/0211826 | A1 * | 8/2013 | Mannby | G10L 19/00 704/201 |
| 2014/0044275 | A1 | 2/2014 | Goldstein et al. | |

(Continued)

OTHER PUBLICATIONS

International Search Report and Written Opinion for International Application No. PCT/CN2014/080821 dated Mar. 30, 2015; 15 pages.

*Primary Examiner* — Paul Huber
(74) *Attorney, Agent, or Firm* — International IP Law Group, P.L.L.C.

(57) ABSTRACT

An apparatus for audio beamforming is composed of a wearable device (100). Wearable device (100) includes a central processing unit (102), motion sensors (116) and microphones (118). Multiple microphones (118) of wearable device (100) are used to create a microphone array that can be beamformed towards the speaker's voice. A method for adjusting beamforming is also provided.

25 Claims, 10 Drawing Sheets

(56) References Cited

U.S. PATENT DOCUMENTS

| | | | | |
|---|---|---|---|---|
| 2014/0045463 | A1 | 2/2014 | Hsieh et al. | |
| 2014/0270217 | A1* | 9/2014 | Ivanov | H04R 29/005 381/66 |
| 2014/0270231 | A1* | 9/2014 | Dusan | G10L 25/90 381/74 |
| 2014/0278394 | A1* | 9/2014 | Bastyr | G10L 21/0208 704/233 |

* cited by examiner

200

300A

300B

400A

400B

500A

500B

600

BEAMFORMING AUDIO WITH WEARABLE DEVICE MICROPHONES

CROSS REFERENECE TO RELATED APPLICATIONS

Pursuant to 35 U.S.C. § 371, this application is the United States National Stage Application of International Patent Application No. PCT/CN2014/080821, filed on Jun. 26, 2014,".

TECHNICAL FIELD

This disclosure relates generally to microphone arrays and beamforming. More specifically, the disclosure describes wearable devices that include one or more microphones and the formation of microphone arrays that can be beamformed.

BACKGROUND

Wearable devices such as smartwatches can include microphones that are capable of capturing and processing a person's voice. For example, a person can record a message or dictate a voice command by talking into a smartwatch. However, the sound that a smartwatch can capture is limited by relative motion of the smartwatch with respect to a target audio source. For example, for optimal performance, a user may turn the smartwatch to face the user so that the microphone will aim towards the user's mouth. The smartwatch can then capture and process the user's voice.

BRIEF DESCRIPTION OF DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DETAILED DESCRIPTION

Figure 1:
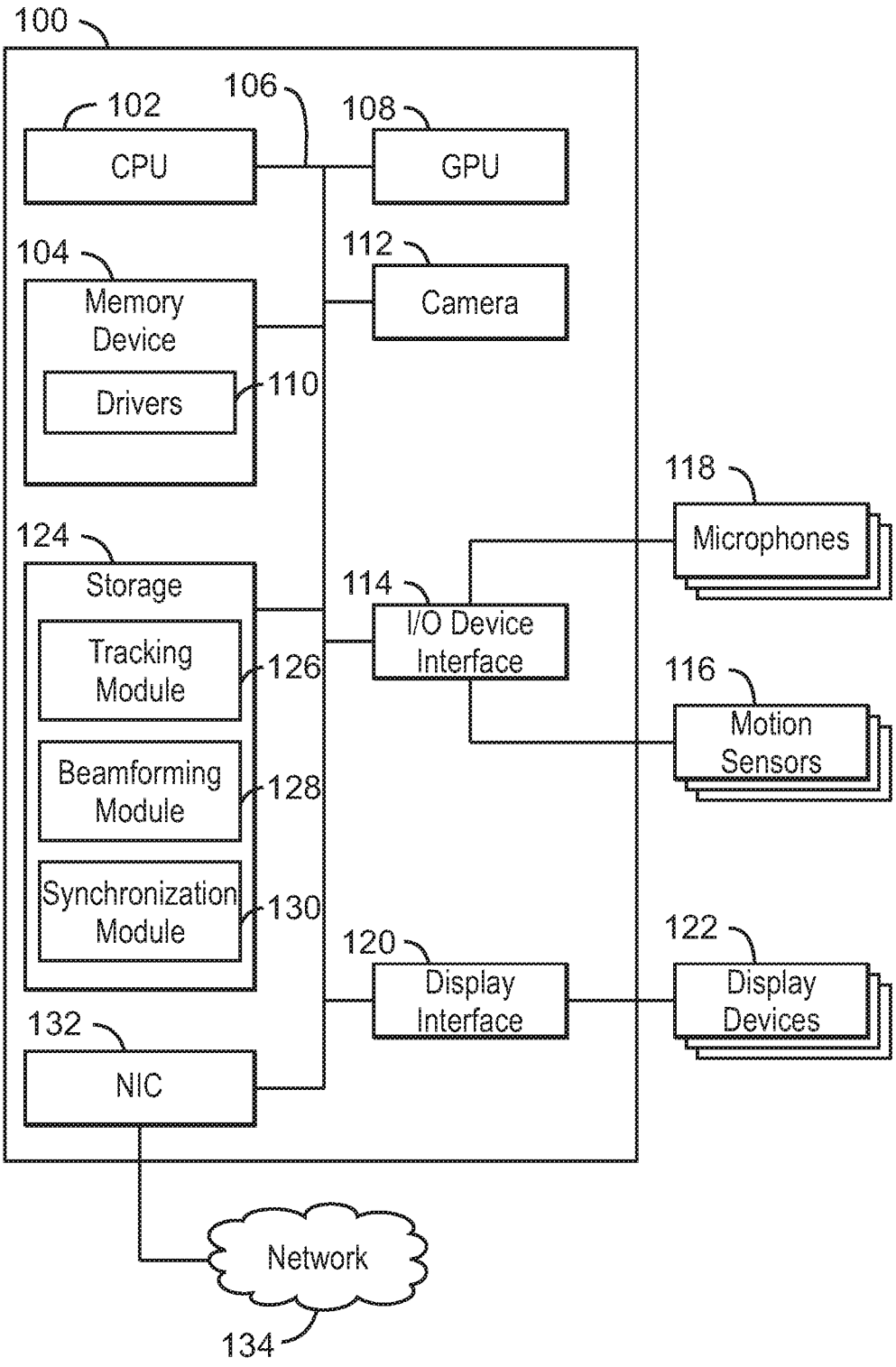
FIG. 1 is a block diagram of a computing device that may be used for beamforming a microphone array.

As discussed above, a user may turn a smartwatch towards his or her face in order to have optimal performance of voice commands or any other type of operation involving audio capture. However, this results in a suboptimal user experience as the turning of the watch occupies a user's hand for the period of the audio capture. Furthermore, in extended periods of speech, using the watch to speak over a phone for example may result in tiring the arm of the user. Finally, activities such as driving, for example, may require the use of both hands to be placed in a certain position for safety reasons. Having to turn the smartwatch and keep aiming at the user while the user carries out a phone call using the smartwatch is a very poor usage model.

Embodiments disclosed herein enable beamforming of the microphones on a smartwatch and other wearable devices. The beamforming of a microphone array that includes a wearable device enables audio to be captured and thus voice control to be used without having to hold a specific or constant posture. Thus, audio may be captured and voice control can be implemented without having to turn and hold an arm towards a user's face. As used herein, a wearable device includes any article of clothing or accessory that can be worn and has a computing device embedded within.

Some embodiments may be implemented in one or a combination of hardware, firmware, and software. Further, some embodiments may also be implemented as instructions stored on a machine-readable medium, which may be read and executed by a computing platform to perform the operations described herein. A machine-readable medium may include any mechanism for storing or transmitting information in a form readable by a machine, e.g., a wearable device. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

FIG. 1 is a block diagram of a computing device that may be used for beamforming a microphone array. The computing device 100 may be, for example, a smartphone, a smartwatch, or a car computer, among others. The computing device 100 may include a central processing unit (CPU) 102 that is configured to execute stored instructions, as well as a memory device 104 that stores instructions that are executable by the CPU 102. The CPU 102 may be coupled to the memory device 104 by a bus 106. Additionally, the CPU 102 can be a single core processor, a multi-core processor, a computing cluster, or any number of other configurations. Furthermore, the computing device 100 may include more than one CPU 102. The memory device 104 can include random access memory (RAM), read only memory (ROM), flash memory, or any other suitable memory systems. For example, the memory device 104 may include dynamic random access memory (DRAM).

The computing device 100 may also include a graphics processing unit (GPU) 108. As shown, the CPU 102 may be coupled through the bus 106 to the GPU 108. The GPU 108 may be configured to perform any number of graphics operations within the computing device 100. For example, the GPU 108 may be configured to render or manipulate graphics images, graphics frames, videos, or the like, to be displayed to a user of the computing device 100.

The memory device 104 can include random access memory (RAM), read only memory (ROM), flash memory, or any other suitable memory systems. For example, the memory device 104 may include dynamic random access memory (DRAM). The memory device 104 may include a device driver 110 that is configured to execute the instructions for beamforming. The device driver 110 may be software, an application program, application code, or the like.

The computing device 100 includes a camera 112. The camera 112 can be used to take pictures or video. For example, the camera 112 can be used for video conferencing.

The CPU 102 may also be connected through the bus 106 to an input/output (I/O) device interface 114 configured to connect the computing device 100 to one or more motion sensors 116 and microphones 118. The motion sensors may include, for example, an accelerometer or gyroscope, among others. In some examples, motion sensors 116 may be two or more accelerometers that are built into the computing device 100. For example, one accelerometer may be built into each side of a wearable device. In some examples, the microphones 118 include two or more microphones 118 built into the computing device 100. The microphones 118 may be directional. In embodiments, the microphones 118 may be formed into microphone arrays that are then beamformed. For example, two microphones 118 on the wearable device may beamform onto a speaker's voice. In some examples, the microphone array can include external microphones. For example, a microphone array that includes the microphones of a smartwatch can also include microphones that are built into a car.

The CPU 102 may also be linked through the bus 106 to a display interface 120 configured to connect the computing device 100 to a display device 122. The display device 122 may include a display screen that is a built-in component of the computing device 100. The display device 122 may also include a computer monitor, television, or projector, among others, that is externally connected to the computing device 100. For example, the display device 122 can include a car display, a smartphone display, or a smartwatch display, among others.

The computing device also includes a storage device 124. The storage device 124 is a physical memory such as a hard drive, an optical drive, a thumbdrive, an array of drives, or any combinations thereof. The storage device 124 may also include remote storage drives. The storage device 124 includes a tracking module 126, a beamforming module 128, and a synchronization module 130. The tracking module 126 may be used to track the position and detect movement of the wearable device 100. The beamforming module 126 may be used to perform beamforming based on detected movements of the computing device. In some examples, the beamforming module 126 can also adjust beamforming based on detected change in relative strength of an audio signal between different microphones. The beamforming module 126 may also have other noise removal features. For example, the beamforming module 126 may have features that can detect and remove ambient noise from audio signals received by microphones 118.

As used herein, beamforming includes a signal processing technique in microphone arrays for directional signal reception. In some examples, directional signal reception can be achieved by combining elements in a phased array in such a way that signals at particular angles experience constructive interference while others experience destructive interference. For example, if voice signals received from the microphone are out of phase, they partially cancel each other out due to destructive interference. If the signals are in phase, they will be amplified when summed due to constructive interference. In some embodiments, the beamforming module 126 can apply beamforming to the audio sources, using their location with respect to microphones of the computing device 100. For example, the audio source location for a driver and passenger in a car can be given a default location. Based on the audio received by microphones 118, an optimal beamforming point can be determined and beamforming can be modified such that users do not need to be equidistant from each microphone.

In some embodiments, the beamforming module 126 can detect a change in the optimal beamforming point. For example, the driver's head can move out of the initial optimal point of beamforming. In some examples, the beamforming module 126 may detect such movement through a change in detected voice strength at microphones 118. For example, if such a change in voice strength is detected and the accelerometer 116 does not indicate movement of the smartwatch, then the driver's head can be assumed to be moving. The beamforming module 126 can then search a certain range of space against the original optimal point to find a new optimal beamforming point. However, if the accelerometer 116 indicates hand movement, then additional sensors can be used to determine the driver's head has moved. For example, if the driver is wearing smartglasses containing another accelerometer 116, then the detected movement of the smartglasses can be directly used to detect movement of the driver's head.

The synchronization module 130 may be used to synchronize audio and video. For example, the synchronization module 130 may synch audio and video at a low level synchronization in order to synch the movement of the lips of a speaker to the voice of the speaker in a video stream.

The computing device 100 may also include a network interface controller (NIC) 132. The NIC 132 may be configured to connect the computing device 100 through the bus 106 to a network 134. The network 134 may be a wide area network (WAN), local area network (LAN), or the Internet, among others. In some examples, the device may communicate with other devices through a wireless technology. For example, Bluetooth® or similar technology may be used to connect with microphones of other devices.

The block diagram of FIG. 1 is not intended to indicate that the computing device 100 is to include all of the components shown in FIG. 1. Rather, the computing system 100 can include fewer or additional components not illustrated in FIG. 1 (e.g., sensors, power management integrated circuits, additional network interfaces, etc.). The computing device 100 may include any number of additional components not shown in FIG. 1, depending on the details of the specific implementation. Furthermore, any of the functionalities of the CPU 102 may be partially, or entirely, implemented in hardware and/or in a processor. For example, the functionality may be implemented with an application specific integrated circuit, in logic implemented in a processor, in logic implemented in a specialized graphics processing unit, or in any other device.

Figure 2:
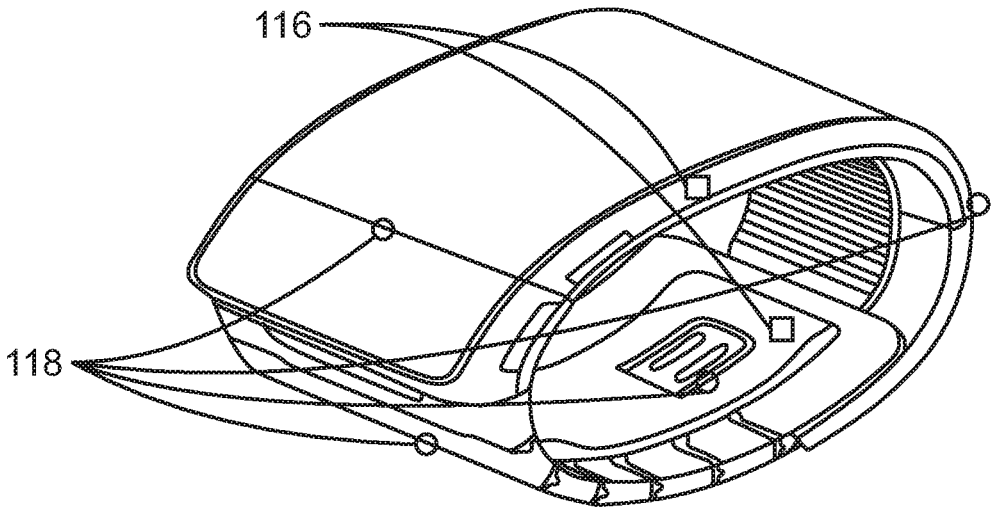
FIG. 2 is an example smartwatch that may be used for beamforming a microphone array.

FIG. 2 is an example smartwatch 100 that may be used for beamforming a microphone array. The smartwatch includes two motion sensors 116 and four microphones 118. The specific configuration of the smartwatch in FIG. 2 is generally referred to by the reference number 200.

In the example of FIG. 2, one motion sensor 116 is embedded in the smartwatch display while another motion sensor 116 is embedded in the wristband of the smartwatch 200. In embodiments, the microphones of the smartwatch 200 are used to create a microphone array. For example, two of the microphones 118 closest to the smartwatch display can be used to capture voice commands from a speaker wearing the watch on a right hand.

The microphones can form a microphone array that can then be beamformed towards the speaker's voice. An array may be selected based on data indicating which microphones are best suited to capture audio signals from the user. In embodiments, the data indicating which microphones are best suited may be data gathered from the motion sensors 116. In this scenario, the motion sensors 116 may be used to detect movement of the smartwatch 200, and microphones selected for the array may be dynamically adjusted based on the detected movement. For example, a person may be driving, wherein the disposition of the smartwatch 200 in relationship to the user's mouth may change during driving. The motion sensors 116 discussed above in regard to FIG. 1, may track a change in disposition of the smartwatch and adjust the selection of the microphones 118 to form a microphone array. The selected array may then be used to beamform as a result of the gathered motion data, as discussed in more detail below in reference to the examples of FIGS. 4A and 4B below.

Therefore, as discussed above, in some examples, the detected movement of the smartwatch 200 can be used to form a different microphone array. Two or more microphones 118 on the smartwatch 200 can then be used to form a different microphone array. For example, a user may turn an arm so that the smartwatch display is facing away from the user's face. The microphones 118 on the wristband of the smartwatch 200 can then be used to form a microphone array for capturing the user's voice.

Figure 3A:
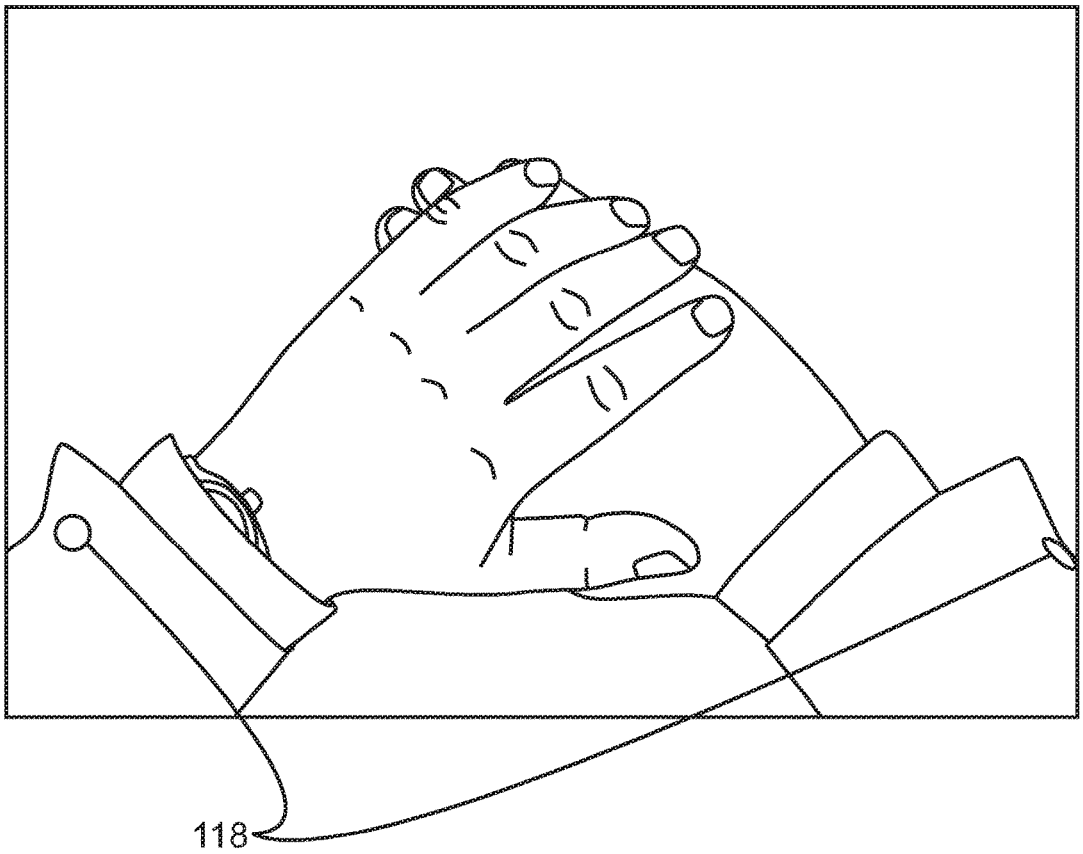
FIG. 3A is an example of two microphones in the form of buttons on the sleeves of a suit jacket.

FIG. 3A is an example of two microphones in the form of buttons on the sleeves of a suit jacket. The suit jacket includes two microphones 118, one on each sleeve of the jacket. The microphones 118 may be configured to communicate audio data to a wearable device, such as the smartwatch 200 discussed above in reference to FIG. 2, or the computing device 100 discussed above in reference to FIG. 1. The particular arrangement of the wearable device in FIG. 3A is referred to by the reference number 300A.

In the example of FIG. 3A, the microphones 118 can be used to form beamforming microphone array. As the position of crossed hands on a table is a natural gesture, a user may be able to inconspicuously record and beamform a conversation such as an important meeting. An advantage of such design is that the spacing between the microphones provides plenty of tolerance for beamforming the voice of a speaker with a variety of head movements.

Figure 3B:
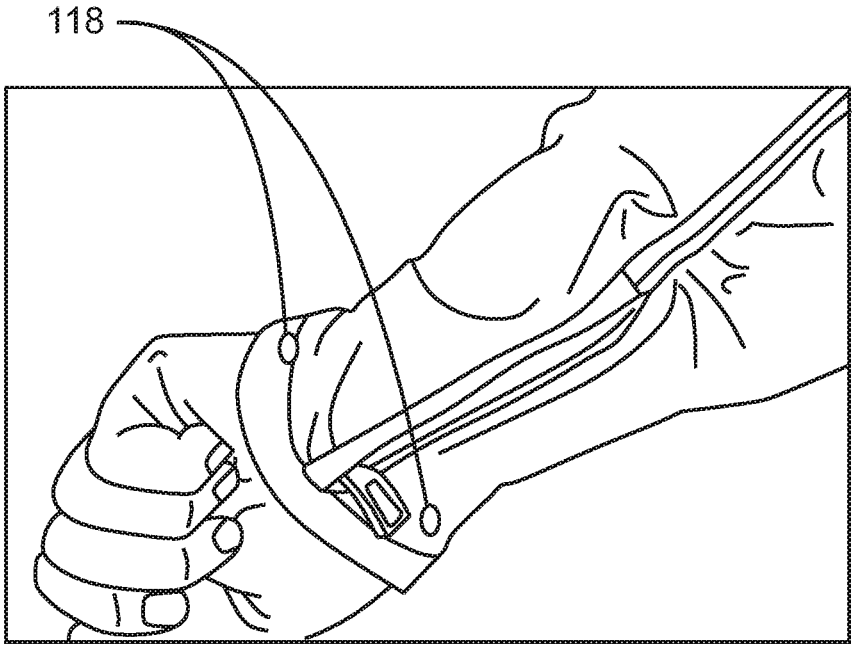
FIG. 3B is an example of two microphones in the form of buttons on a jacket sleeve.

FIG. 3B is an example of two microphones 118 in the form of buttons on a jacket sleeve. The two microphones 118 are embedded into the jacket on the underside of the user's wrist so as to resemble two regular buttons on a jacket. The particular arrangement of the wearable device in FIG. 3B is referred to by the reference number 300B.

In the example of FIG. 3B, two microphones are embedded into a single sleeve. The spacing of between the buttons is enough to allow for beamforming using only one sleeve, while enabling a total of four microphones to be used if needed. An advantage of this design is inconspicuous operation while doubling the amount of microphones that can be used to form a microphone array for beamforming.

Figure 4A:
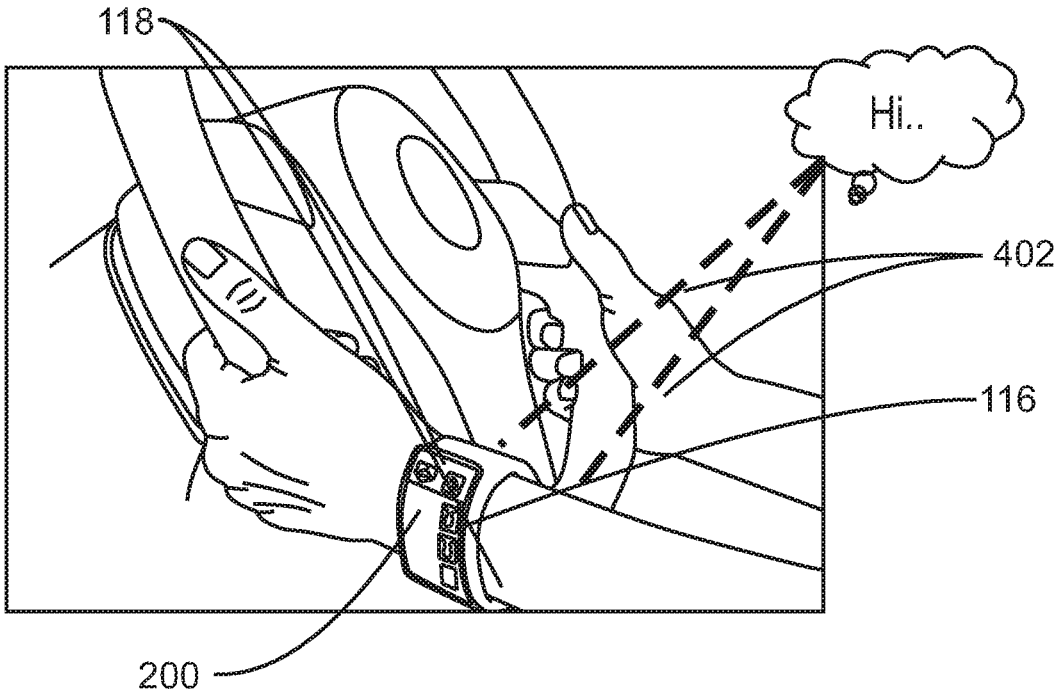
FIG. 4A is an example smartwatch being used to beamform the voice of a driver.

FIG. 4A is an example smartwatch 200 being used to beamform the voice of a driver. The smartwatch 200 includes two microphones 118 on either side of the smartwatch display. Two dotted lines 402 indicate beamforming in a direction towards an audio source, such as the user of the smartwatch 200. The particular arrangement of the smartwatch in FIG. 4A is referred to by the reference number 400A.

In the example of FIG. 4A, the two microphones 118 are beamformed towards the driver as indicated by the dotted lines 402. In the example, the driver is using the smartwatch 200 to greet a friend over a phone connection. For example, the smartwatch 200 may be configured to place voice communications, or can be connected via a wireless connection to a smartphone or a car phone. In some examples, the driver can be accessing a calendar and taking notes for a meeting, or checking the time of an appointment.

In embodiments, beamforming is initially directed at a programmable default location. For example, once the driver sits in the seat and the microphones 118 receive a voice input, the default driver location is initially used to beamform the driver's voice. In some examples, the default location for both the driver and the passenger may be programmed. Once a voice input is received from the driver or passenger, the beamforming module 126 can begin searching a range of space for an optimized point for beamforming the respective voice.

Figure 4B:
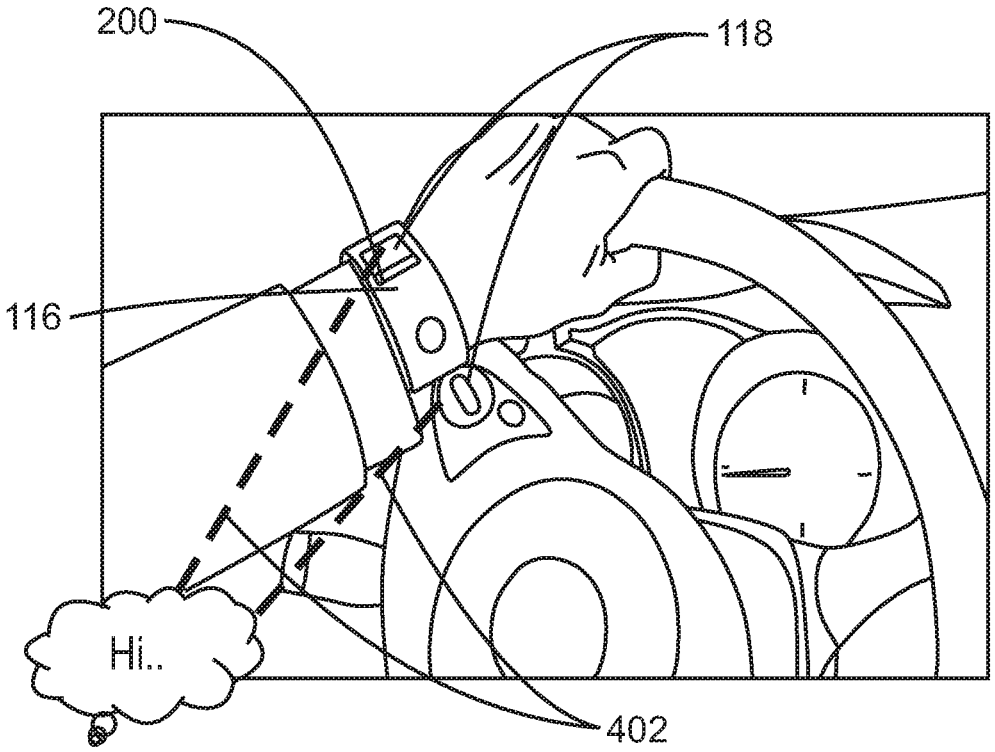
FIG. 4B is an example smartwatch continuing to beamform the voice of a driver after the steering wheel has been turned.

FIG. 4B is an example smartwatch 200 continuing to beamform the voice of a driver after the steering wheel has been turned. The smartwatch 200 includes two microphones 118 on the wristband of the smartwatch 200. The two dotted lines 402 indicate beamforming direction towards a target audio source, such as the user in the scenario illustrated in FIG. 4B. The particular arrangement of the smartwatch in FIG. 4B is referred to by the reference number 400B.

In the example of 4B, the user has turned the steering wheel in order to make a right turn. The position of the smartwatch 200 has therefore changed relative to the user's mouth. However, as shown by the two dotted lines, the beamforming has been maintained in the direction of the user's voice. In embodiments, the smartwatch can detect this movement via a motion sensor 116. The smartwatch 200 can then switch the microphones 118 in a microphone array if necessary and adjust beamforming to ensure consistent capturing of the user's voice. In some examples, the smartwatch 200 may have automatic gain control which can be used to keep the user's voice at a constant volume. For example, if the microphones 118 selected in a given array are switched or the beamforming is adjusted, the user's voice will not sound any louder or softer to the friend because of the automatic gain control.

Figure 5A:
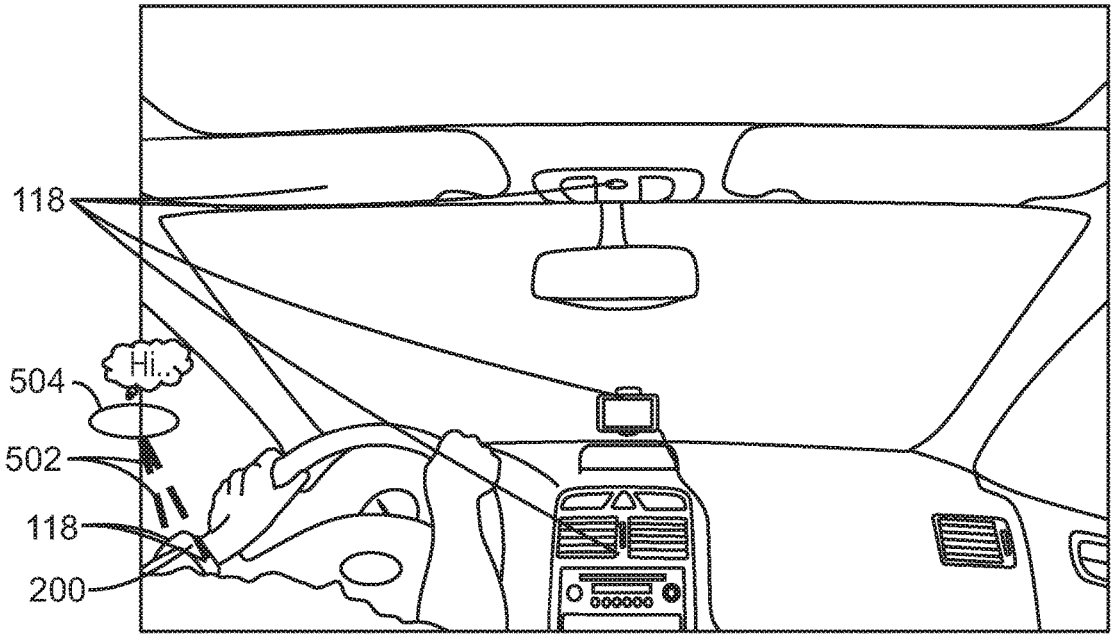
FIG. 5A is an example car interior with microphones being used to capture ambient noise.

FIG. 5A is an example car interior with microphones being used to capture ambient noise. In the example of 5A, four microphones 118 are integrated into the car interior 500 and two microphones 118 are in the smartwatch 200. Again, the dotted lines 502 indicate beamforming direction. A region of audio capture for beamforming, also known as a sweet spot, is indicated by an oval 504 where the driver's mouth is disposed. The particular arrangement of the beamforming system in FIG. 5A is referred to by the reference number 500A.

In the example of FIG. 5A, the two microphones of smartwatch 200 are being used in a microphone array that is beamforming onto the voice of the driver. In some embodiments, the other microphones disposed throughout the car interior 500 may be used to capture ambient noise. Ambient noise can include unwanted background noise such as motor noise, wind noise, or music being played by the car speakers. For example, the microphones 118 integrated into the car may be used to capture ambient noise profiles and remove the noise from the voice audio captured by the two microphones 118 of the smartphone 200. In some embodiments, one or more of the car microphones can be used in the microphone array to beamform onto the driver's voice. In some embodiments, the car microphones 118 can be used to separately beamform onto another voice. For example, the car microphones 118 can be used to beamform onto a passenger's voice while microphones 118 of the smartphone 200 are used to beamform the voice of the driver.

Figure 5B:
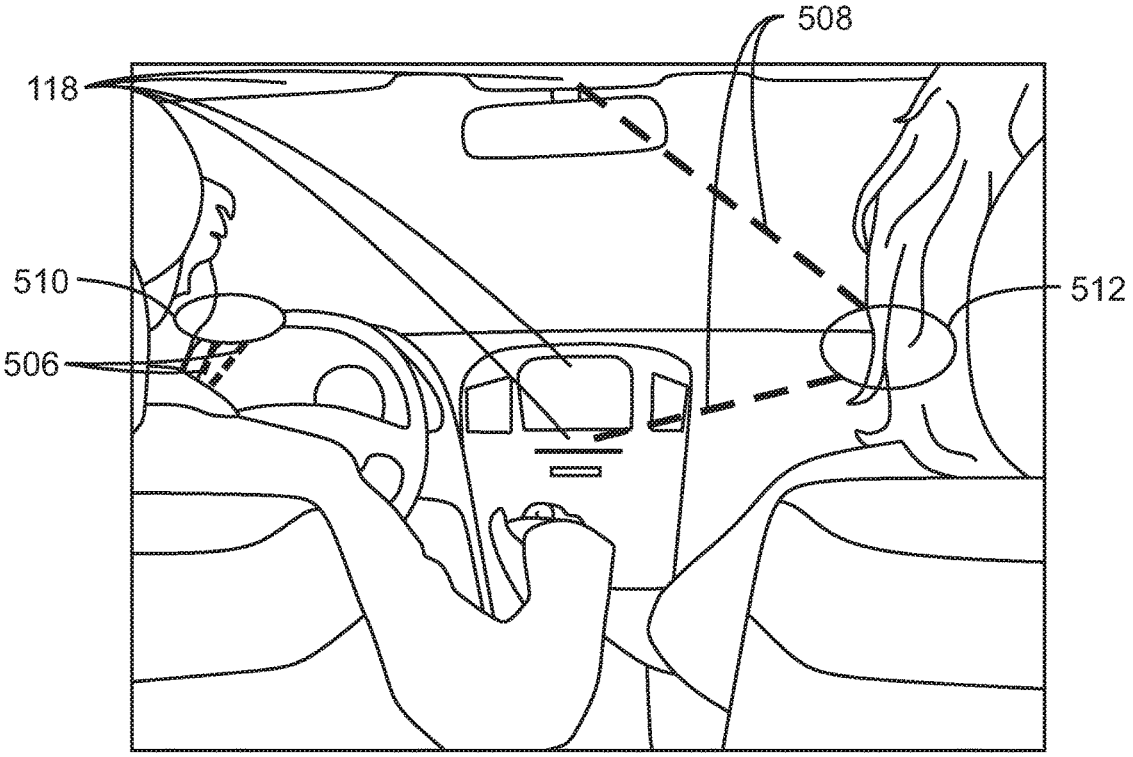
FIG. 5B is an example car interior with microphones being used to beamform onto a passenger.

FIG. 5B is an example car interior with microphones 118 that can be used to beamform onto a passenger. The car interior includes four integrated microphones 118. Two sets of beamforming microphones have their respective beamforming directions indicated by dotted lines 506, 508 and two ovals 510, 512 indicate the respective beamforming sweet spots over the mouths of the driver and the passenger. The particular arrangement of the beamforming system in FIG. 5B is referred to by the reference number 500B.

In the example of 5B, both the driver and the passenger are speaking concurrently. For example, the driver may be speaking to someone via a smartwatch while the passenger is using voice commands to operate the car console. In some embodiments, a driver may be using two microphones on the smartwatch (not shown) to form a microphone array for beamforming onto the driver's voice and two of the integrated microphones in the car may be used to create a second microphone array for beamforming onto a secondary audio source. For example, the second microphone array may beamform onto the passenger's voice. In some examples, an additional array may be created for each passenger. In some examples, an array may beamform onto two or more passengers.

Figure 6:
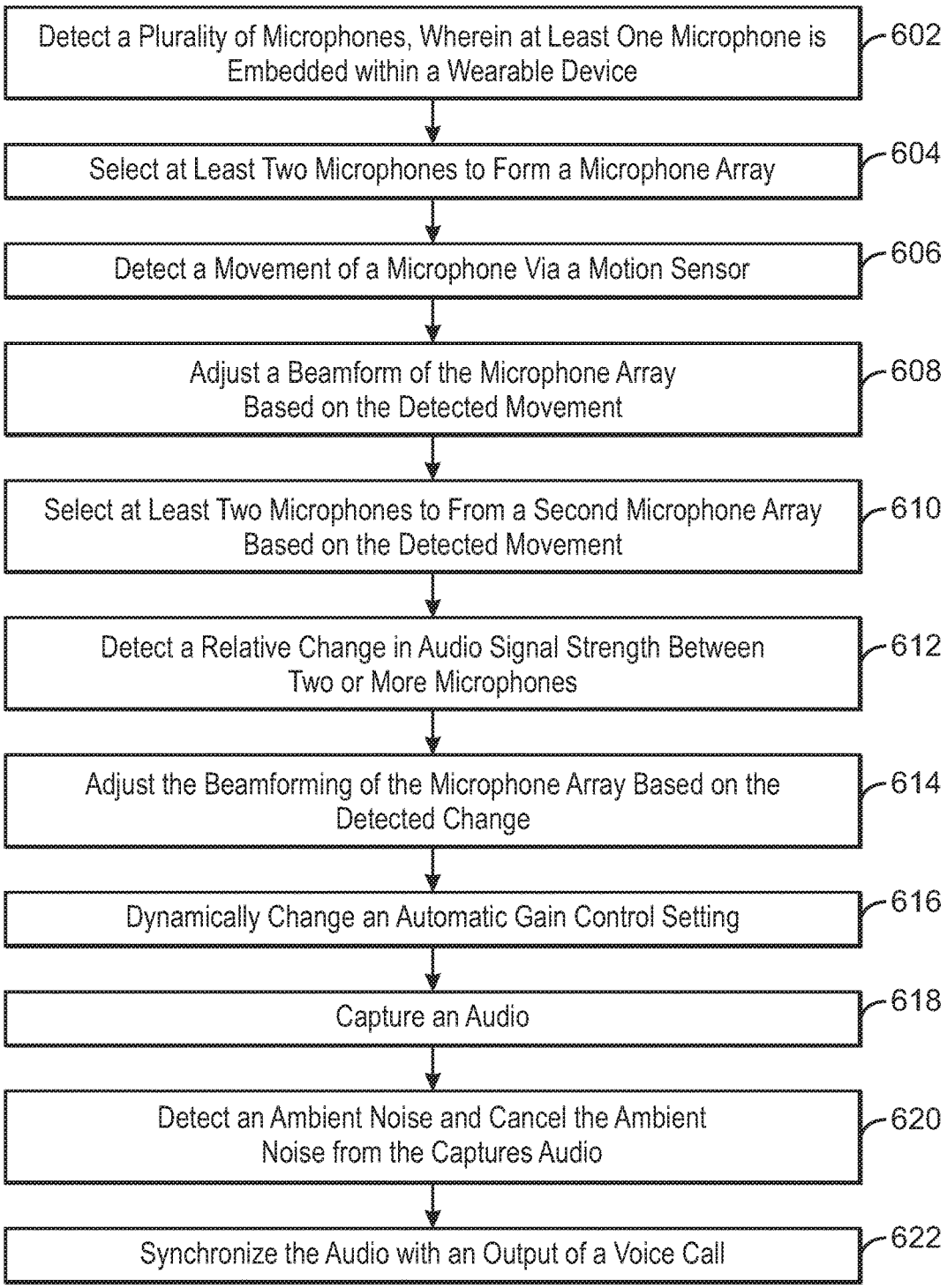
FIG. 6 is an example method to adjust beamforming for movement of a wearable device.

FIG. 6 is an example method to adjust beamforming for movement of a wearable device. In various embodiments, the method 600 is used to beamform audio using a wearable device. In some embodiments, the method 600 may be executed on a computing device, such as computing device 100.

At block 602, tracking module 126 detects a plurality of microphones 118, wherein at least one microphone 118 is embedded within a wearable device 100. In some embodiments, the plurality of microphones may include microphones 118 that are integrated into a car system in addition to one or more microphones that may be embedded in a wearable device. In some examples, the wearable device may be a smartwatch, such as the smartwatch 200 discussed above in reference to FIG. 2.

At block 604, the beamforming module 128 selects at least two microphones 118 to form a microphone array. In some examples, the user may select whether the wearable device is to be worn on a right side or a left side, such that the beamforming module 128 discussed above in reference to FIG. 1 may select which microphones 118 may be used in the microphone array.

In some embodiments, the beamforming module 128 may detect whether the wearable device is to be worn on a right side or a left side when selecting the microphones 118 to form the microphone array. For example, if a smartwatch is to be worn on a driver's left hand, then the beamforming module 128 may initially choose two microphones on the smartwatch that would give facing the driver's mouth in a driving position with hands on the steering wheel. In some embodiments, the microphones can be included in the array based on a comparison of audio signals as captured by each microphone. For example, the beamforming module 128 may only include microphones with the strongest signals in the microphone array.

At block 606, the tracking module 126 detects a movement of a microphone 118 via a motion sensor 116. In embodiments, the motion sensor 116 may be embedded into a computing device 100 that contains microphone 118. For example, the tracking module can detect the movement of a smartwatch 200.

At block 608, the beamforming module 128 adjusts a beamform of the microphone array based on the detected movement. For example, a microphone array may include the microphones 118 of a smartwatch 200. The beamforming module 128 can adjust beamforming of the array given a detected movement of smartwatch 200. In some examples, adjusting beamforming may include adjusting a delay applied to some of the captured audio signals before summing them to produce a beamformed audio. For example, the delay applied to audio signals captured by the moving smartwatch may be adjusted by the beamforming module 128 for the detected movement. In some examples, the beamforming module 128 can calculate an excursion of the device from a predetermined default position using the detected movement and then adjust beamforming accordingly.

At block 610, the beamforming module can select at least two microphones 118 to form a second microphone array based on the detected movement. In some embodiments, the beamforming module can select two or more different microphones to continue beamforming onto the same voice. In some embodiments, the beamforming module 128 may continue to use some microphones from the array of block 604 while adding or subtracting microphones to produce a new array for improved beamforming based on the detected movement.

At block 612, the beamforming module 128 can detect a relative change in audio signal strength between two or more microphones 118. For example, a driver may exhibit facial movement such as a turning of the head to the right or the left. The facial movement can be detected by the beamforming modules 118 in conjunction with audio signal strength received at the microphones 118 and the detected movement of motion sensors 116. For example, if audio signal strength changes, and the motion sensors 116 do not detect motion at the microphones, then the audio source may have changed position.

At block 614, the beamforming module 128 can adjust the beamforming of the microphone array based on the detected change and the detected movement of the motion sensor. For example, in response to a turning of a driver's head while talking, the beamforming module 128 may reposition the beamforming sweet spot so that the driver's mouth remains within the sweet spot. In some examples, the beamforming module 128 can select microphones for form a second microphone array based on the detected movement. For example, the second microphone array have a sweet spot at the new position of the driver's head.

At block 616, the beamforming module 128 can dynamically apply an automatic gain control setting. For example, a driver may be turning a steering wheel of a car while speaking to someone over the phone. During the turn, the beamforming module 128 may adjust beamforming or select different microphones to capture the driver's voice. In some examples, the adjustments may create fluctuations in the volume of the speaker's voice. For example, the selection of a new microphone array for beamforming in block 610 above may produce a change in volume with the change of microphone arrays. The beamforming module 128 may thus dynamically apply automatic gain control to the speaker's voice as beamformed into an audio so that these fluctuations in volume are reduced. The application of the automatic gain control is dynamic in the sense that it is not always in use, but can be applied when and if necessary. For example, gain control can be turned on when accelerometer 116 detects movement of the smartwatch 200.

At block 618, the beamforming module 128 can capture audio. In embodiments, the audio can be the voice of one or more speakers. For example, the voice can belong to the person wearing a smartwatch or other wearable device. In some embodiments, the beamforming module 128 can enlarge the sweet spot so as to capture 2 or more speakers. For example, a user may want to capture audio from a meeting and record the voices of all the speakers at the meeting.

At block 620, the beamforming module 128 can detect an ambient noise and cancel the ambient noise from the captured audio. In some embodiments, one or more microphones that are not being used to beamform audio may be used instead to capture ambient noise. For example, the ambient noise inside a vehicle may be captured by microphones integrated into the vehicle to produce an ambient noise profile. The beamforming module 128 can use the ambient noise profile to further filter out unwanted ambient noise from the beamformed audio. Thus, the ambient noise captured can be fed to the beamforming module 128 to enhance the beamforming performance.

At block 622, the synchronization module 130 can synchronize the audio with an output of a voice call. In some embodiments, the synchronization module may synchronize audio with an output of a voice call using a form of low level synchronization. For example, if a user is video conferencing, there may be a time delay associated with various microphones collecting the audio and transferring that audio to a centralized location for processing. The synchronization module 130 can resolve the voice delay from various microphones, and also lip sync the audio with the video that is being captured simultaneously.

Figure 7:
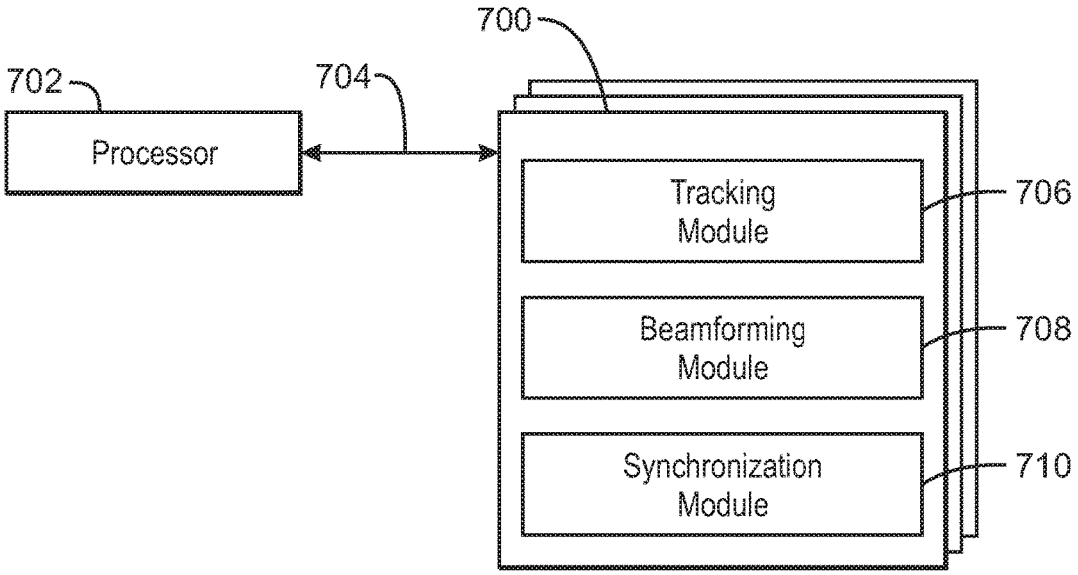
FIG. 7 is an example tangible, computer readable medium that can be used to adjust beamforming of a wearable device.

FIG. 7 is an example tangible, computer readable medium that can be used to adjust beamforming of a wearable device. In some examples, the wearable device may be a smartwatch 200. The tangible, machine-readable media 700 may be accessed by a processor 702 over a computer bus 704. Furthermore, the tangible, machine-readable medium 700 may include code configured to direct the processor 702 to perform the methods described herein.

The various software components discussed herein may be stored on one or more tangible, machine-readable media 700, as indicated in FIG. 7. For example, a tracking module 706 may be configured to detect microphones and movements of the microphones. A beamforming module 708 may be configured to beamform audio from one or more audio sources. For example, an audio source can be a user of the wearable device. In some examples, the beamforming module 708 can be used to adjust beamforming based on detected movements of the computing device. For example, the beamforming module 708 can calculate an excursion generated by the detected movement from a predetermined default position. In some examples, the default position can include a specific position in a car or a position on the left side or right side of a user. The beamforming module 708 can then adjust beamforming according to the excursion. In some embodiments, the beamforming module 708 can also adjust beamforming based on detected change in relative strength of an audio signal between different microphones and the detected movement. For example, an audio signal can become louder as captured by some microphones and softer in others. The relative change in strength of audio signal indicates a movement of the audio source and thus results in the beamforming module 708 recalculating the optimal beamforming spot. The movement sensor can be used to determine whether the change in audio signal strength is due to movement of the microphone or the audio source. In some examples, the beamforming module 708 can reselect microphones 118 to form a second microphone array based on the detected movement.

In some embodiments, the beamforming module 708 can dynamically apply an automatic gain control setting. For example, the automatic gain control can be used to keep a speaker's voice at a consistent volume. In some embodiments, the beamforming module 708 can also remove noise. For example, the beamforming module 708 can have features that can detect and remove ambient noise from audio signals received at microphones 118.

A synchronization module 710 may be configured to synchronize audio with video. For example, the movement of a user's lips may be synched with the user's voice. In some embodiments, the synchronization module 710 may synchronize audio with video. For example, the synchronization module 710 can resolve the voice delay from various microphones and lip sync the audio with the video that is being captured simultaneously.

The block diagram of FIG. 7 is not intended to indicate that the tangible, machine-readable media 700 is to include all of the components shown in FIG. 7. Further, the tangible, machine-readable media 700 may include any number of additional components not shown in FIG. 7, depending on the details of the specific implementation.

EXAMPLE 1

An apparatus for audio beamforming is described herein. The apparatus includes a wearable device. The apparatus also includes logic, at least partially comprising hardware logic, to beamform a microphone array onto a target audio source. The logic is also to detect a movement of the device. The logic further is to adjust the beamforming of the microphone array based on the movement of the device. The logic can capture and amplify audio from the target audio source. A volume of the captured audio can be maintained at a predetermined amplitude. The apparatus can be a smartwatch. At least one of the microphones can be on the smartwatch and at least one additional microphone can be embedded in a wristband of the smartwatch. The device can be embedded into clothing and at least one of microphones can resemble a button. The logic can also receive user input as to whether the device is to be worn on a left or a right side. Adjusting the beamforming of the array can include calculating an excursion of the device from a predetermined default position based on the detected movement of the device. Adjusting the beamforming of the array can include adding or removing a microphone from the plurality of microphones to the array. The logic can also detect a relative change in the audio signal strength as captured by two or more microphones. The logic can further adjust the beamforming of the microphone array based on the detected relative change in audio signal strength and the detected movement of the device. The device can be embedded in a shirt, a jacket, or a suit.

EXAMPLE 2

A system for adjusting beamforming is described herein. The system includes at least one motion sensor embedded in a wearable device and a plurality of microphones. At least one of the microphones is embedded in the wearable device. The system includes logic to detect audio via the plurality of microphones. The system also includes logic to detect an audio source for beamforming based on the detected audio. The system includes logic to select a set of microphones to form a microphone array for beamforming on the audio source. The system includes logic to detect movement of the at least one embedded microphone via the at least one motion sensor. The system also further includes logic to adjust the set of microphones to update the microphone array for beamforming on the audio source. The wearable device can include two or more microphones. The selected microphones of the array can also include the two or more microphones of the device. At least one of microphones can also be integrated into a vehicle. The integrated microphone can be included in the microphone array. The system can include logic to cancel noise using the integrated microphone. The system can also further include logic to select a second set of microphones from the plurality of microphones to form a second microphone array for beamforming on a secondary audio source. The system can also include logic to beamform on a second audio source using the integrated microphone in a second microphone array. The system can further include logic to dynamically apply an automatic gain control setting. The system can also include logic to capture an audio and video and synchronize the audio with the video. The system can also further includes logic to detect a change in a relative audio signal strength and adjust beamforming on the audio source based on the detected change and a detected movement of the at least one motion sensor.

EXAMPLE 3

A method for adjusting beamforming is described herein. The method includes detecting a plurality of microphones. At least one microphone is embedded within a wearable device. The method includes selecting at least two microphones to form a microphone array for beamforming on a target. The method includes detecting a movement of a microphone via a motion sensor. The method further includes adjusting the beamform of the microphone array based on the detected movement. Adjusting the beamform can include calculating an excursion of at least one microphone from a predetermined default position from the detected movement. The method can further include detecting a relative change in audio signal strength between two or more microphones. The method can also further include adjusting the beamforming of the microphone array based on the detected change and the detected movement of the at least one motion sensor. The method can also include dynamically applying an automatic gain control setting. The method can further include detecting an ambient noise. The method can also include capturing an audio and cancelling the ambient noise from the captured audio. The method can include capturing an audio and synchronizing the audio with a video of a video conference call. Selecting at least two microphones to form a microphone array can further include detecting whether the wearable device is to be worn on a right side or a left side. The method can also include selecting at least two microphones to form a second microphone array based on the detected movement of the microphone. The wearable device can be a smartwatch.

EXAMPLE 4

At least one tangible, machine-readable medium for beamforming audio is described herein. The tangible, machine-readable medium has instructions stored therein that, in response to being executed on a computing device, cause the computing device to detect a plurality of microphones. At least one microphone is embedded within a wearable device. The tangible, machine-readable medium further includes instructions to cause the computing device to select at least two microphones to form a microphone array. The tangible, machine-readable medium can also include instructions to detect a movement of a microphone via at least one motion sensor. The tangible, machine-readable medium also includes instructions to adjust a beamform of the microphone array based on the detected movement. The tangible, machine-readable medium can also include instructions to calculate an excursion of at least one microphone from a predetermined default position from the detected movement. The tangible, machine-readable medium can further include instructions to detect a relative change in audio signal strength between two or more microphones. The tangible, machine-readable medium can also include instructions to adjust the beamforming of the microphone array based on the detected change and the detected movement of the at least one motion sensor. The tangible, machine-readable medium can include instructions to dynamically apply an automatic gain control setting. The tangible, machine-readable medium can include instructions to capture an audio. The tangible, machine-readable medium can also include instructions to detect an ambient noise. The tangible, machine-readable medium can also further include instructions to cancel the ambient noise from the captured audio. The tangible, machine-readable medium can include instructions to capture an audio and synchronize the audio with a video. The tangible, machine-readable medium can further include instructions to detect whether the wearable device is to be worn on a right side or a left side. The tangible, machine-readable medium can also include instructions to cause the computing device to reselect at least two microphones to form a second microphone array based on the detected movement. The computing device can be a smartwatch.

EXAMPLE 5

An apparatus for beamforming is described herein. The method includes means for beamforming an audio from a target audio source. The method also includes means for detecting a movement of the apparatus. The method further includes means for adjusting beamforming of the audio based on the detected movement of the apparatus. The method can include means for detecting a movement of the target audio source. The method can also include means for adjusting beamforming based on the detected movement of the audio source. The method can further include means for detecting and communicating with a car microphone. The method can also further include means for beamforming a second audio from a second audio source. The method can include means for applying and dynamically applying an automatic gain control on the audio. The method can also include means for detecting ambient noise. The method can also include means for cancelling the noise from the audio. The method can further include means for detecting whether the apparatus is being worn on a right side or a left side. The method can also further include means for forming a microphone array that includes the car microphone. The method can also include means for synchronizing the audio with a video.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the computing device described above may also be implemented with respect to either of the methods or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An apparatus for audio beamforming, comprising:
a wearable device; and
logic, at least partially comprising hardware logic, to:
beamform a microphone array onto a target audio source;
detect a movement of the device; and
adjust the beamforming of the microphone array based on the movement of the device, wherein at least one microphone of the microphone array is integrated into a vehicle.

2. The apparatus of claim 1, further comprising logic to capture and amplify audio from the target audio source, wherein a volume of the captured audio is maintained at a predetermined amplitude.

3. The apparatus of claim 1, wherein the device is a smartwatch.

4. The apparatus of claim 3, wherein at least one of the microphones are on the smartwatch and at least one additional microphone is embedded in a wristband of the smartwatch.

5. The apparatus of claim 1, wherein the device is embedded into clothing and at least one of microphones resembles a button.

6. The apparatus of claim 1, further comprising logic to receive user input as to whether the device is to be worn on a left or a right side.

7. The apparatus of claim 1, wherein adjusting the beamforming of the array comprises calculating an excursion of the device from a predetermined default position based on the detected movement.

8. The apparatus of claim 1, wherein adjusting the beamforming of the array comprises adding or removing a microphone from the plurality of microphones to the array.

9. The apparatus of claim 1, further comprising logic to:
detect a relative change in the audio signal strength as captured by two or more microphones; and
adjust the beamforming of the microphone array based on the detected relative change in audio signal strength and the detected movement.

10. The apparatus of claim 1, wherein the device is embedded in a shirt, a jacket, or a suit.

11. The apparatus of claim 1, wherein the at least on microphone integrated into the vehicle is to capture ambient noise profiles, and the device is to remove noise from audio captured by other microphones of the microphone array.

12. A system for adjusting beamforming, comprising:

at least one motion sensor embedded in a wearable device;

a plurality of microphones, at least one of which is embedded in the device; and logic to:

detect audio via the plurality of microphones;

detect an audio source for beamforming based on the detected audio;

select a set of microphones to form a microphone array for beamforming on the audio source;

detect movement of the at least one embedded microphone via the at least one motion sensor; and adjust the set of microphones to update the microphone array for beamforming on the audio source, wherein at least one microphone of the microphone array is integrated into a vehicle.

13. The system of claim 12, wherein the device comprises two or more microphones and wherein the selected microphones of the array comprise the two or more microphones of the device.

14. The system of claim 12, wherein the integrated microphone is included in the array.

15. The system of claim 12, further comprising logic to cancel noise using the integrated microphone.

16. The system of claim 12, further comprising logic to select a second set of microphones from the plurality of microphones to form a second microphone array for beamforming on a secondary audio source.

17. The system of claim 12, further comprising logic to beamform on a second audio source using the integrated microphone in a second microphone array.

18. The system of claim 12, further comprising logic to dynamically apply an automatic gain control setting.

19. The system of claim 12, further comprising logic to capture an audio and video and synchronize the audio with the video.

20. The system of claim 12, further comprising logic to detect a change in a relative audio signal strength and adjust beamforming on the audio source based on the detected change and a detected movement of the at least one motion sensor.

21. At least one non-transitory, machine-readable medium for beamforming audio having instructions stored therein that, in response to being executed on a computing device, cause the computing device to:

detect a plurality of microphones, wherein at least one microphone is embedded within a wearable device and another microphone is integrated into a vehicle;

select at least two microphones to form a microphone array;

detect a movement of a microphone via at least one motion sensor; and adjust a beamform of the microphone array based on the detected movement.

22. The at least one non-transitory, machine readable medium of claim 21, further comprising instructions to calculate an excursion of at least one microphone from a predetermined default position from the detected movement.

23. The at least one non-transitory, machine readable medium of claim 21, further comprising instructions to:

detect a relative change in audio signal strength between two or more microphones; and adjust the beamforming of the microphone array based on the detected change and the detected movement of the at least one motion sensor.

24. The at least one non-transitory, machine readable medium of claim 21, further comprising instructions that cause the computing device to dynamically apply an automatic gain control setting.

25. The at least one non-transitory, machine readable medium of claim 21, further comprising instructions that cause the computing device to:

capture an audio;

detect an ambient noise; and cancel the ambient noise from the captured audio.

* * * * *